US005294265A

United States Patent [19]

Gray et al.

[11] Patent Number: 5,294,265

[45] Date of Patent: Mar. 15, 1994

[54] NON-CHROME PASSIVATION FOR METAL SUBSTRATES

[75] Inventors: Ralph C. Gray, Butler; Michael J. Pawlik, Glenshaw; Paul J. Prucnal, Pittsburgh; Christopher J. Baldy, Warrendale, all of Pa.

[73] Assignee: PPG Industries, Inc., Pittsburgh, Pa.

[21] Appl. No.: 31,508

[22] Filed: Mar. 15, 1993

Related U.S. Application Data

[63] Continuation-in-part of Ser. No. 862,143, Apr. 2, 1992.

[51] Int. Cl.[5] ..... C23C 22/02

[52] U.S. Cl. ..... 148/250

[58] Field of Search ..... 148/250

[56] References Cited

U.S. PATENT DOCUMENTS

| | | | |
|---|---|---|---|
| 3,269,812 | 8/1966 | Irani et al. | 44/72 |
| 3,956,199 | 5/1976 | Dawson et al. | 252/545 |
| 4,051,110 | 9/1977 | Quinlan | 260/72 R |
| 4,621,112 | 11/1986 | Backhouse et al. | 524/145 |
| 4,717,424 | 1/1988 | Wilfinger et al. | 106/308 Q |
| 4,735,649 | 4/1988 | Dhingra et al. | 71/86 |
| 4,777,091 | 10/1988 | Dettloff et al. | 428/418 |
| 4,781,984 | 11/1988 | Cavitt et al. | 428/418 |
| 4,921,552 | 5/1990 | Sander et al. | 14.8/247 |
| 4,992,116 | 2/1991 | Hallman | 148/247 |
| 5,026,440 | 6/1991 | Finnenthal et al. | 148/247 |
| 5,034,556 | 7/1991 | Kahle, II | 558/155 |
| 5,139,586 | 8/1992 | Das | 148/246 |

FOREIGN PATENT DOCUMENTS

| | | |
|---|---|---|
| 1276822 | 6/1972 | United Kingdom . |
| 2138424 | 10/1984 | United Kingdom . |

OTHER PUBLICATIONS

Helmut Blum and Peter Christophliemk, "Technical Aminopolymethylenephosphonic Acids as Scale Inhibitors", *Phosphorus and Sulfur*, 1987, vol. 30, pp. 619–622.

Phosphates Division of Albright & Wilson, 'Briquest' Phosphonates as Sequestrants and Surfactants, pp. 1–4, Product Technical Information.

Phosphates Division of Albright & Wilson, 'Briquest' ADPA-60A, Acetodiphosphonic Acid Aqueous Solution, 2 sheets.

Monsanto Company, "Dequest 2000 and 2006 Phosphonates", Technical Bulletin No. IC/WT-101, 5 sheets.

Monsanto Company, "Dequest 2010 Phosphonate", Technical Bulletin No. IC/SCS-323, 3 sheets.

Monsanto Company, "Dequest 2041 and 2051 Phosphonates", 7 sheets.

Monsanto Company, "Dequest 2060 Organophosphorus Product", Technical Bulletin No. IC/SCS-322, 3 sheets.

Albright & Wilson Inc. "Organophosphorus Chemicals", 1 sheet; "Flame Retardants", 2 sheets; "Surfactants", 2 sheets; "Functional Fluid Additives and Precursors", 2 sheets; "Sequestrants, Corrosion and Scale Inhibitors", 1 sheet; "Lubricant Additives", 1 sheet; "Inorganic Chemicals"; 2 sheets; "Proprietary Metal Finishing Processes", 1 sheet; and "Products by Industry", 2 sheets.

Alfred Bader, "How to Find a Great Herbicide", *Aldrichimica Acta*, vol. 21, No. 1, 1988.

Goncalves et al, Chemical Absracts, vol. 89, No. 129606 (1978).

Goncalves et al, Chemical Abstracts, vol. 89, No. 129607 (1978).

*Primary Examiner*—Sam Silverberg

*Attorney, Agent, or Firm*—William J. Uhl

[57] ABSTRACT

Aqueous acid solutions for treating metal surfaces such as aluminum and galvanized steel are disclosed. The solutions are mixtures of organophosphates or phosphonates and chloride or fluoride. The treating solutions can be used in place of chromium treating solutions.

20 Claims, No Drawings

NON-CHROME PASSIVATION FOR METAL SUBSTRATES

This application is a continuation-in-part of application Ser. No. 07/862,143, filed Apr. 2, 1992.

FIELD OF THE INVENTION

This invention relates to an aqueous acidic treating composition and to a method for passivating metal substrates, particularly zinc, aluminum and their alloys. More particularly, this invention relates to aqueous acidic treating compositions which do not contain chromium and to the use of these compositions for passivating metal substrates.

BRIEF DESCRIPTION OF THE PRIOR ART

It is known to treat metal substrates, particularly zinc and aluminum and their alloys, with chromium containing compositions to inhibit corrosion and promote adhesion of subsequently applied coatings. While effective, these chromium treatments have several disadvantages.

First, chromium treatments can cause yellow or blue discoloration of the substrate. In addition, darkening of the substrate is occasionally observed after the chromium treated substrate has been post-oiled for forming or lubrication. Also, once the metal substrate is chromium treated, no further post-treatment of the substrate, such as zinc phosphating, can be performed. This makes chromium treated metals unsuitable for use in coil coating and automotive applications. Lastly, chromium is undesirable because of toxicity and waste disposal concerns.

SUMMARY OF THE INVENTION

The present invention encompasses an aqueous acidic solution for treating metal surfaces, a method for treating metal surfaces and the metal substrate treated by the method. The term "metal" is meant to include zinc, aluminum and their alloys.

The aqueous acidic treating solution is comprised of a compound or mixture of compounds selected from the class consisting of organophosphates, which are the epoxy esters of phosphoric acid, or organophosphonates, which are the epoxy esters of a phosphonic acid, and a halide ion selected from fluoride or chloride. The metals are treated by contacting the substrate with the acidic treating solution such as by immersion, spraying or roll coating.

DETAILED DESCRIPTION OF THE INVENTION

The organophosphates used in the aqueous treating solutions are phosphoric acid esters prepared from the reaction of phosphoric acid and an epoxide. The epoxides useful in the practice of the invention are 1,2-epoxides having an epoxy equivalency of at least 1, specifically, monoepoxides having a 1,2-epoxy equivalent of 1 or polyepoxides having a 1,2-epoxy equivalent of 2 or more.

Illustrative examples of the monoepoxides are monoglycidyl ethers of monohydric phenols or alcohols such as phenyl glycidyl ether and butyl glycidyl ether. Examples of polyepoxides are polyglycidyl ethers of polyhydric phenols, which are preferred, such as the polyglycidyl ether of 2,2-bis(4-hydroxyphenyl)propane (bisphenol A) and 1,1-bis(4-hydroxyphenyl)isobutane. Besides polyhydric phenols, other cyclic polyols can be used particularly cycloaliphatic polyols such as hydrogenated bisphenol A. In addition, polyglycidyl ethers of polyhydric alcohols such as ethylene glycol, 1,2-propylene glycol and 1,4-butylene glycol can be used. Mixtures of monoepoxides and polyepoxides may also be used.

The organophosphonates are phosphonic acid esters prepared from the reaction of a phosphonic acid and a 1,2-epoxide such as the monoepoxides and polyepoxides mentioned above. Examples of suitable phosphonic acids are those having at least one group of the structure:

$$-R-PO-(OH)_2$$

where R is —C—, preferably $CH_2$ and more preferably $O-CO-(CH_2)_2$. Examples of useful phosphonic acids include 1-hydroxyethylidene-1,1-diphosphonic acid, carboxyethyl phosphonic acid and alpha-aminomethylene phosphonic acids i.e., those where R is $$>N-CH_2-$$

such as (2-hydroxyethyl)aminobis(methylenephosphonic) acid and isopropylaminobis (methylenephosphonic) acid. The aminomethylene phosphonic acids are described in U.S. Pat. No. 5,034,556, column 2, line 52, to column 3, line 43.

Examples of suitable organophosphonates include the carboxyethylene phosphonic acid esters of butyl diglycidyl ether, cyclohexyl diglycidyl ether, phenylglycidyl ether and bisphenol A diglycidyl ether and mixtures thereof.

The organophosphate or organophosphonate should be soluble in an aqueous medium to the extent of at least 0.03 grams per 100 grams of water at 25° C. An aqueous medium is meant to include water or water in combination with a cosolvent such as an alkyl ether of a glycol, such as 1-methoxy-2-propanol, dimethylformamide, xylene, or a base such as an amine which can partially or completely neutralize the organophosphate or organophosphonate to enhance the solubility of these compounds. Examples of suitable amines include diisopropanolamine, triethylamine, dimethylethanolamine, 2-amino-2-methylpropanol. Diisopropanolamine is preferred. The organophosphate or organophosphonate is typically present in the treating solution in concentrations between 0.5 and 10.0 percent by weight, preferably between 1.0 and 5.0 percent based on weight of the treating solution.

The aqueous treating solution also contains fluoride or chloride ions. Suitable sources of fluoride or chloride ions include hydrofluoric acid, hydrochloric acid, fluorosilicic acid, sodium hydrogen fluoride, and potassium hydrogen fluoride. Complex fluoride containing compounds such as fluorotitanic acid, fluorozirconic acid, potassium hexafluorotitanate and potassium hexafluorozirconate can also be used. Hydrofluoric acid and hydrochloric acid are preferred. The acidic fluoride or chloride compounds are typically present in the aqueous treating solution in amounts between 300 to 3500 parts per million (ppm), preferably between 800 and 1200 ppm.

The acidic treating solution typically contains a weight ratio of organophosphate or organophosphonate to fluoride or chloride ion in the range of 10:1 to 55:1. Additionally, the acidic treating solution will typically have a pH of less than 6.0, preferably 2.0 to 5.0, and more preferably from 2.7 to 3.5. The pH can be adjusted by the addition of a base such as sodium hydroxide. pH levels lower than 2.0 are not preferred because of a decrease in treating solution performance (i.e., an increase of corrosion) and "burning" or blackening of nonferrous metal substrates. A pH level above 5.0 is less effective for corrosion resistance.

The metal substrates contacted by the acidic treating solution include zinc, aluminum and their alloys and are preferably nonferrous. A typical treatment process would include cleaning the metal substrate by a physical or chemical means, such as mechanically abrading the surface or cleaning with commercial alkaline/caustic cleaners. The cleaning process is then usually followed by a water rinse and contacting the substrate with the acidic treating solution.

The method of contacting the substrate with the acidic treating solution can be by immersion, spray, or roll-coating. This can be accomplished on a part by part or batch process or via a continuous process in which a substrate such as a coil strip is contacted with the treating solution in a continuous manner. The temperature of the treating solution is typically from about 15° C. to 85° C., preferably between 20° C. and 60° C. Time of contact is usually between 0.1 and 300 seconds, preferably 0.5 to 180 seconds.

Continuous processes are typically used in the coil coating industry and also for mill passivation of unpainted strip. In the coil industry, the substrate is cleaned and rinsed and then usually contacted with the treating solution by roll coating with a chemical coater. The treated strip is then dried by heating and then painted and baked by conventional coil coating processes.

Mill passivation may be applied to the freshly manufactured metal strip by immersion, spray or roll coating. Excess treating solution is then removed typically with wringer rolls, optionally given a water rinse and allowed to dry. If the substrate is already heated from the hot melt production process, no post application heating of the treated substrate is required to facilitate drying. Alternately, the treated substrate may be heated at about 65° C. to 125° C. for 2 to 30 seconds.

Optionally the treated substrate may be post rinsed with an aqueous solution of an alkaline earth salt, such as an alkaline earth nitrate. Examples of acceptable alkaline earth nitrates include calcium nitrate, magnesium nitrate and strontium nitrate. Calcium nitrate is preferred. The use of alkaline earth nitrates are believed to enhance corrosion protection of nonferrous metal substrates by forming insoluble complexes with excess fluoride or chloride ions. Furthermore, the substrate may be post-oiled with a lubricating oil prior to transport or storage.

The advantages of the present invention allow for the treated substrate to be stored or transported under humid conditions minimizing the formation of white rust corrosion observed with untreated nonferrous metal substrates. In addition, the treating solutions avoid the problems of chromium treating solutions which not only create disposal problems, but do not allow for the chromium treated substrate to be post-treated and painted. Typical chrome passivation is difficult to remove and, if not completely removed, leads to adhesion failure of subsequently applied post-treatments and coatings. The claimed acidic treating solution can be post-treated with compounds, such as zinc phosphate and the like, and subsequently coated with conventional coating finishes.

The present invention is further illustrated by the following non-limiting examples. All parts are by weight unless otherwise indicated.

EXAMPLES

The following examples show the preparation of an organophosphate and organophosphonate formed from reacting phosphoric or a phosphonic acid and an epoxide, as well as the preparation of a calcium nitrate post rinse solution. Treating solutions were then formulated with the organophosphates and organophosphonates of various epoxides and hydrofluoric, hydrochloric or fluorosilicic acid. Galvanized steel panels were then treated with the treating solutions and evaluated for humidity and corrosion resistance.

EXAMPLE A

Preparation of EPON 828 Organophosphate

The diisopropylamine salt of the phosphoric acid ester of bisphenol A diglycidyl ether (EPON 828 available from Shell Chemical Company) was made by first charging 67.6 grams of 85 percent phosphoric acid into a 2 liter flask under a nitrogen blanket which was maintained throughout the reaction. 1-methoxy-2-propanol (67.6 grams) was then added. The mixture was heated to 120° C. followed by the addition of 332.4 grams of EPON 828 premixed with 1-methoxy-2-propanol (85 to 15 weight ratio) over 30 minutes. The temperature of the reaction mixture was maintained at 120° C. When the addition was complete, the temperature was held at 120° C. for another 30 minutes followed by the addition of 63.4 grams of deionized water over a 5 minute period. When the water addition was completed, the mixture was held for 2 hours at reflux (106° C.) followed by cooling to 70° C. Premelted diisopropanolamine (100.6 grams) was then added to the reaction mixture at 70° C. and the reaction mixture stirred for 15 minutes. The pH of the reaction mixture was adjusted to 6.0 by adding small amounts of diisopropanolamine. The reaction mixture was then further thinned with an additional 309.7 grams of deionized water.

EXAMPLE B

Preparation of Phenylglycidyl Ether Organophosphonate

The organophosphonate of phenylglycidyl ether was made by first charging the following to a 3 liter, 4 neck, round bottom flask fitted with a thermometer, stainless steel stirrer, nitrogen inlet, heating mantle and reflux condenser:

| | |
|---|---|
| Carboxyethyl phosphonic acid | 154 grams |
| Dimethylformamide | 100 grams |

When a clear solution was obtained at 50° C., a mixture of 300 grams of phenylglycidyl ether was added over 1.5 hours while controlling the reaction exotherm at 55°-60° C. with an ice bath. The solution was heated to 100° C. and held at 100° C. for 3.5 hours after which a measured epoxy equivalent weight of 1882 and an acid value of 164 mg KOH/gm sample was obtained. An additional 4 hours of heating at 100° C. gave an epoxy equivalent of 1937.

EXAMPLE C

Preparation of EPON 828 Organophosphonate

The organophosphonate of EPON 828 was made by charging 154 grams of carboxyethyl phosphonic acid and 154 grams of 1-methoxy-2-propanol to a 3 liter, 4 neck, round bottom flask fitted with a thermometer, stainless steel stirrer, nitrogen inlet, heating mantle and reflux condenser. When a clear solution was obtained at 50° C., a mixture of 378 grams of EPON 828 and 50 grams of 1-methoxy-2-propanol was added over thirty minutes maintaining the temperature between 50°-60° C. with an ice bath. The solution remained heated for another 1.5 hours following the last addition of the EPON 828 mixture. The solution was then heated to 100° C., held for 1.5 hours, after which an additional 100 grams of 1-methoxy-2-propanol was added to adjust viscosity. The solution remained heated for an additional 2.5 hours and gave an epoxy equivalent weight of 18,000 and an acid value of 98.3 mg KOH/gm sample.

EXAMPLE D

Preparation of Calcium Nitrate Post Rinse Solution

A post rinse solution was made by adding 4.7 grams of calcium nitrate hydrate to 1 liter of deionized water. The solution contained 1000 ppm calcium and had a pH of 5.7.

EXAMPLE 1

Preparation of EPON 828 Organophosphate and Hydrofluoric Acid Treating Solution An aqueous solution of the organophosphate of Example A was prepared by adding, with stirring, 101.5 grams of the reaction product of Example A to 1 liter of deionized water. The concentration of the organophosphate was 5 percent by weight, based on weight of the solution. An acidic treating solution was then prepared by adding 1.95 grams of 49 percent by weight of hydrofluoric acid to the organophosphate solution to produce a bath which contained 900 ppm fluoride at a pH of 3.0.

EXAMPLE 2

Preparation of EPON 828 Organophosphate and Hydrochloric Acid Treating Solution Example 1 was repeated except that hydrofluoric acid was omitted and 2.7 grams of 37 percent hydrochloric acid was added to 1 liter of the 5 percent organophosphate solution. The resultant solution contained 950 ppm chloride and had a pH of 2.9.

EXAMPLE 3

Preparation of EPON 828 Organophosphate and Fluorosilicic Acid Treating Solution Example 1 was repeated except that hydrofluoric acid was omitted and 2.6 grams of 23 percent fluorosilicic acid was added to 1 liter of a 3 percent organophosphate solution. The resultant solution contained 950 ppm fluoride and had a pH of 4.2.

EXAMPLE 4

Preparation of EPON 1031 Organophosphate and Fluorosilicic Acid Treating Solution Example A was repeated except that the phosphoric acid ester of EPON 828 was replaced with the phosphoric acid ester of EPON 1031 (which is a tetraglycidyl ether available from Shell Chemical Company). An aqueous solution of organophosphate was then prepared by adding, with stirring, 40.3 grams (solution weight) of the phosphoric acid ester of EPON 1031 to 1 liter of deionized water. The concentration of the organophosphate was 2 percent by weight, based on the weight of solution. An acidic treating solution was then prepared by adding 2.6 grams of 23 percent fluorosilicic acid to the organophosphate solution to produce a solution which contained 950 ppm fluoride at a pH of 2.9.

EXAMPLE 5

Preparation of EPIREZ 5022 Organophosphate and Fluorosilicic Acid Treating Solution Example A was repeated except that the phosphoric acid ester of EPON 828 was replaced with the phosphoric acid ester of EPIREZ 5022 (which is the diglycidyl ether of 1,4-butanediol available from Shell Chemical Company) and 99.1 grams of phosphoric acid. An aqueous solution of organophosphate was then prepared by adding, with stirring, 64.7 grams (solution weight) of the EPIREZ 5022 reaction product to 1 liter of deionized water. The concentration of the organophosphate was 3 percent by weight, based on weight of the solution. An acidic treating solution was then prepared by adding 2.6 grams of 23 percent fluorosilicic acid to the organophosphate solution to produce a solution which contained 950 ppm fluoride at a pH of 4.9.

EXAMPLE 6

Preparation of EPONEX 1511 Organophosphate and Hydrofluoric Acid Treating Solution Example A was repeated except that the phosphoric acid ester of EPON 828 was replaced with the diglycidyl ether of EPONEX 1511 (which is a hydrogenated bisphenol A diglycidyl ether available from Shell Chemical Company). An aqueous solution of organophosphate was then prepared by adding, with stirring, 105.7 grams (solution weight) of the EPONEX 1511 reaction product to 1 liter of deionized water. The concentration of the organophosphate was 5 percent by weight, based on weight of the solution. An acidic treating solution was then prepared by adding 3.3 grams of 49 percent hydrofluoric acid to the organophosphate solution to produce a solution which contained 3300 ppm fluoride at a pH of 2.9.

EXAMPLE 7

Preparation of EPON 828 Organophosphonate and Fluorosilicic Acid Treating Solution An aqueous solution of the organophosphonate of Example C was prepared by adding, with stirring, 20.9 grams (solution weight) of the reaction product of Example B to 1 liter of deionized water. The concentration of the organophosphonate was 1.5 percent by weight based on weight of the solution. An acidic treating solution was then prepared by adding 2.6 grams of fluorosilicic acid and 5.0 grams of diisopropanolamine to the organophosphonate solution to produce a solution containing 950 ppm fluoride at a pH of 3.6.

EXAMPLE 8

Preparation of Phenylglycidyl Ether Organophosphonate and Fluorosilicic Acid Treating Solution An aqueous solution of the organophosphonate of Example B was prepared by adding, with stirring, 18.3 grams (solution weight) of the phenylglycidyl ether reaction product and 5 grams of diisopropanolamine to 1 liter of deionized water. The concentration of organophosphonate was 1.5 percent by weight, based on weight of the solution. An acidic treating solution was then prepared by adding 2.6 grams of 23 percent fluorosilicic acid to the organophosphonate solution to produce a solution which contained 950 ppm fluoride at a pH of 4.0.

EXAMPLE 9

Prepartion of EPON 1031 Organophosphonate and Fluorosilicic Acid Treating Solution Example C was repeated except that EPON 828 and dimethylformamide were omitted and replaced with 176 grams of EPON 1031 and 154 grams of 1-methoxy-2-propanol. An aqueous solution of the organophosphonate was then prepared by adding, with stirring, 30 grams (solution weight) of the EPON 1031 reaction product and 7.25 grams of diisopropanolamine to 1 liter of deionized water. The concentration of organophosphonate was 1.5 percent by weight, based on weight of the solution. An acidic bath solution was then prepared by adding 3.25 grams of 23 percent fluorosilicic acid to the organophosphonate solution to produce a bath containing 1190 ppm fluoride at a pH of 4.1.

Humidity Resistance Test Results

Hot dipped galvanized panels were immersed in acidic treating solutions of the examples described above at a temperature of 60° C. for 5 seconds. The panels were removed from the bath and run through squeegee rolls to remove excess solution. The treated panels were then subjected to a humidity test in a QCT chamber. Humidity resistance was determined by using the treated panels as the ceiling of the humidity chamber with the treated side directed inward. A 2 inch level of water was located 3 to 5 inches below the treated panel. The QCT test was conducted by exposing panels at an angle of 30° from vertical and 100% humidity at 54° C. Performance was measured with respect to the percent of white corrosion stain on the treated panel after the exposure time (in hours) reported in the table.

| EXAMPLE | DESCRIPTION | EXPOSURE TIME | % STAIN |
|---|---|---|---|
| 1 | EPON 828 Organophosphate and HF | 24 | 2 |
| 2 | EPON 828 Organophosphate and HCl | 24 | 30 |
| 3 | EPON 828 Organophosphate and $H_2SiF_6$ | 24 | 2 |
| 4 | EPON 1031 Organophosphate and $H_2SiF_6$ | 4 | 2 |
| 5 | EPIREZ 5022 Organophosphate and $H_2SiF_6$ | 4 | 95 |
| 6 | EPONEX 1511 Organophosphate and HF | 24 | 1 |
| 7 | EPON 828 Organophosphonate and $H_2SiF_6$ | 24 | 30 |
| 8 | Phenyl glycidyl ether Organophosphonate and $H_2SiF_6$ | 24 | 65 |
| 9 | EPON 1031 Organophosphonate and $H_2SiF_6$ | 4 | 5 |
| 10 | Example 3 with calcium nitrate post rinse[1] | 24 | 1 |
| 11 | Example 1 post oiled[2] | 48 | 0 |
| | Control[3] | 2 | 100 |
| | Control[4] | 24 | 3 |

[1]A hot dipped galvanized panel was immersed in the acidic treating solution described in Example 3 at 140° C. for 5 seconds. The panel was removed from the bath and spray rinsed with a 70° C. calcium nitrate post rinse solution described in Example C. After the calcium nitrate post rinse, the panel was run through a squeegee roll to remove excess solution, dried and subjected to the humidity resistance test.

[2]A hot dipped galvanized panel was immersed in the treating solution described in Example 1 at 140° C. for 5 seconds. The panel was removed from the bath, run through a squeegee roll to remove excess solution and dried. The panel was then oiled, using a paper towel, with Rustillo DW924HF lubricant available from Burmah-Castrol, Inc.

[3]A hot dipped galvanized panel which was not subjected to passivation.

[4]A Hot dipped galvanized panel was passivated with a chromium treating solution, JME0100 available from Chemfil Corp. The hot dipped galvanized panel was immersed in a 2.5 to 3 percent by volume solution of JME0100 for 0.5 to 5 seconds at a temperature between 25 and 90° C. The panel was run through a squeegee roll to remove excess treatment solution and subsequently submitted to the humidity resistance test.

Room Temperature Wet Stack Test Results

Hot dipped galvanized panels were immersed in acidic treating solution baths of the examples described above at a temperature of 60° C. for 5 seconds. The panels were removed from the bath and run through squeegee rolls to remove excess solution. Treated panels were subjected to a room temperature stack test which was conducted by misting one side of a panel with a fine mist of deionized water and placing another identical panel on top of the misted panel. This top panel was then misted and the process repeated until a stack of ten panels was obtained. The stack of panels was placed under a 10 pound weight and allowed to sit for one week at 70° C. After one week, all of the panels in a given stack were evaluated for percent white rust corrosion on the surface, were remisted, restacked and retested as described above. Evaluations were conducted at one week intervals until five of the ten panels in a given set had greater than 10% of the surface covered by white rust.

| DESCRIPTION | TIME (in weeks) | % STAIN |
|---|---|---|
| Example 1 EPON 828 Organophosphate and HF | 1 | 35 |
| Example 1 with calcium nitrate post rinse[1] | 4 | 10 |
| Example 1 post oiled[2] | 6 | 3 |
| Example 1 with deionized water post rinse[5] | 1 | 20 |
| Control[3] | 1 | 100 |
| Control[4] | 2 | 15 |
| Control[6] | 1 | 5 |
| Control[7] | 1 | 100 |
| Electrogalvanized substrate[8] | 1 | 10 |
| Galfan substrate[9] | 5 | 10 |
| Galvanneal substrate[10] | 4 | 10 |

-continued

| DESCRIPTION | TIME (in weeks) | % STAIN |
|---|---|---|
| Galvalume substrate[11] | 8 | 2 |

[5]A hot dipped galvanized panel was immersed in the treating solution described in Example 1 at 140° C. for 5 seconds. The panel was removed from the bath, spray rinsed with deionized water, run through a squeegee roll to remove excess solution and dried.

[6]A hot dipped galvanized panel which was oiled, using a paper towel with Rustillo DW924HF lubricant.

[7]A hot dipped galvanized panel which was spray rinsed with a 70° C. calcium nitrate solution described in Example C and dried.

[8]A zinc-aluminum alloy available from Weirton Steel in which the zinc is deposited via a salt bath electrolytically.

[9]A high zinc-aluminum alloy available from Weirton Steel.

[10]A zinc-iron alloy available from Weirton Steel.

[11]A zinc-aluminum alloy available from USX Steel.

We claim:

1. An aqueous acidic solution for treating metal surfaces comprising:

a) a compound selected from the group consisting of epoxy esters of phosphoric acid, epoxy esters of a phosphonic acid and mixtures thereof, b) and a halide ion selected from the group consisting of fluoride and chloride.

2. The solution of claim 1 in which the epoxy compound used in forming the epoxy esters is a 1,2-epoxy compound having an epoxy functionality of two or more.

3. The solution of claim 1 in which the epoxy compound used in forming the epoxy esters is a 1,2-epoxy compound having an epoxy functionality of at least one.

4. The solution of claim 1 in which the epoxy compound used in forming the epoxy esters contains an aromatic group.

5. The solution of claim 1 in which the epoxy compound used in forming the epoxy esters contains a cycloaliphatic group.

6. The solution of claim 1 in which the phosphonic acid is an alpha-carboxyethylene phosphonic acid having at least one group of the structure

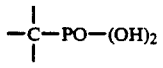

7. The solution of claim 1 in which the halide is fluoride.

8. The solution of claim 7 in which the source of the fluoride ion is fluorosilicic acid.

9. The solution of claim 7 in which the source of the fluoride ion is hydrogen fluoride.

10. The solution of claim 1 which has a pH in the range of 2.0 to 5.0.

11. The solution of claim 1 in which the epoxy esters are at least partially neutralized with an amine.

12. The solution of claim 1 in which the weight ratio of epoxy ester to fluoride or chloride ion is between 10:1 and 55:1.

13. A method of treating non-ferrous metal surfaces comprising contacting the metal surface with the aqueous acidic solution of claim 1.

14. The method of claim 13 in which the metal surface is selected from the class consisting of zinc, aluminum and their alloys.

15. The method of claim 13 in which the surface contacted by the method of claim 14 is rinsed with an aqueous medium.

16. The method of claim 15 in which the aqueous medium is an aqueous solution of an alkaline earth salt.

17. The method of claim 16 in which the alkaline earth salt is an alkaline earth nitrate.

18. The method of claim 17 in which the alkaline earth nitrate is calcium nitrate.

19. The method of claim 13 in which the surface contacted with the solution of claim 1 is further treated with a lubricating oil.

20. The method of claim 13 in which the surface is a continuous strip of metal which is contacted with a bath of the treating solution in a continuous manner.

* * * * *